US011388539B2

(12) United States Patent
Pellegrini

(10) Patent No.: US 11,388,539 B2
(45) Date of Patent: Jul. 12, 2022

(54) METHOD AND DEVICE FOR AUDIO SIGNAL PROCESSING FOR BINAURAL VIRTUALIZATION

(71) Applicant: Sennheiser electronic GmbH & Co. KG, Wedemark (DE)

(72) Inventor: Renato Pellegrini, Niederhasli (CH)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 21 days.

(21) Appl. No.: 17/128,529

(22) Filed: Dec. 21, 2020

(65) Prior Publication Data

US 2021/0195361 A1 Jun. 24, 2021

(30) Foreign Application Priority Data

Dec. 23, 2019 (DE) ..... 102019135690.3

(51) Int. Cl.
*H04S 7/00* (2006.01)
*H04S 1/00* (2006.01)

(52) U.S. Cl.
CPC ..... *H04S 7/303* (2013.01); *H04S 1/007* (2013.01); *H04S 2400/11* (2013.01); *H04S 2400/13* (2013.01); *H04S 2420/01* (2013.01)

(58) Field of Classification Search
None
See application file for complete search history.

(56) References Cited

U.S. PATENT DOCUMENTS

2016/0266865 A1* 9/2016 Tsingos ..... H04S 7/306

FOREIGN PATENT DOCUMENTS

EP 3 063 955 10/2019

* cited by examiner

*Primary Examiner* — Qin Zhu
(74) *Attorney, Agent, or Firm* — Haug Partners LLP

(57) ABSTRACT

Binaurally reproduced audio signals are often perceived as unnatural. For example, speech intelligibility may be reduced. For improving the spatial reproduction of audio signals, the invention enables binaurally virtualizing a single-channel audio signal only partially by filtering. A degree of binaural virtualization for the audio signal based on one or more processing parameters ($P_C$, $P_{FC}$, $P_{TC}$) may be freely chosen. A control allows a smooth transition between a completely binaural virtualization based on HRTF and a non-binaural virtualization corresponding to panning. A first range ($B_1$) starts with a completely binaural virtualization and the HRTFs that are commonly used for this. In this range, the HRTFs are modified by scaling and by approaching them to the gain factors of the panning while decreasing a degree of binaural virtualization. In a subsequent second range ($B_2$) that leads to a completely panning-like virtualization, the resulting phase is reduced, or adjusted to the panning phase of 0°. By selecting one or more processing parameters, different audio signals may be binaurally virtualized to different degrees before being superposed to each other.

17 Claims, 5 Drawing Sheets

METHOD AND DEVICE FOR AUDIO SIGNAL PROCESSING FOR BINAURAL VIRTUALIZATION

CROSS REFERENCE TO RELATED APPLICATION(S)

This application claims the benefit of the foreign priority of German Patent Application No. 10 2019 135 690.3, filed on Dec. 23, 2019, the entirety of which is incorporated herein by reference.

FIELD OF DISCLOSURE

The invention relates to audio signal processing for binaural virtualization.

BACKGROUND

Various solutions are known for audio signals and their spatial reproduction, which differ from each other fundamentally. Two important principles are object-based audio, where the positions of the audio sources are given, and channel-based audio, where the positions of the loudspeakers or reproduction transducers respectively are given. E.g. the well-known stereo and 5.1 surround formats are channel-based. Here, a modification of the spatial perception is commonly achieved by the so-called panning, whereby the amplification or amplitude respectively of each reproduction channel can be controlled. This method is therefore known as amplitude panning. However, a considerably stronger spatial effect can be achieved by binaural audio signal processing, generating separate signals for the left and right ear. It uses head-related transfer functions (HRTFs), which are also known as anatomical transfer functions (ATFs).

FIG. 1 shows the principle of object-based binaural signal processing. In order to binaurally reproduce the (mono) signal of an audio source 11, it is filtered by a binaural filter 12*a*,12*b* each for the left and right side. The binaural reproduction is done through headphones 13 with two sound transducers. For binaurally reproducing multiple audio sources $\mathbf{11}_1, \ldots, \mathbf{11}_N$, their signals are separately filtered $\mathbf{12}a_1, \mathbf{12}b_1, \mathbf{12}a_N, \mathbf{12}b_N$ and superposed for each side, as shown in FIG. 2. The superposition may be done by summation $\mathbf{14}_a$, $\mathbf{14}_b$. For a corresponding spatial reproduction via loudspeakers, however, different filters are required that have structures and features similar to binaural filters. They are called transaural filters. FIG. 3 shows transaural filters 12*c*, 12*d* filtering the (mono) signal of the audio source 11 for spatial reproduction via loudspeakers 15*a*, 15*b*. With binaural or transaural playback, the spatial effect is more evident than with the usual stereo or 5.1 surround playback. However, available audio signals often have stereo or 5.1 surround format, and respective playback systems for these formats are widespread. Due to the predefined fixed positions that loudspeakers have in stereo or 5.1 surround systems respectively, each audio channel can be assigned a direction from which the listener hears the respective signal.

When using headphones, the respective signals of the channels can be processed with a corresponding HRTF each for the left ear and right ear in order to achieve the same hearing impression as with a stereo playback via loudspeakers. In FIG. 2, the audio sources $\mathbf{11}_1, \ldots, \mathbf{11}_N$ may be the two channels of a stereo signal, for example.

A particularly simple alternative for a spatial virtualization in order to give the listener an impression of direction is panning. With panning, the signals are not processed by HRTFs, but the directional effect is only simulated by a sound level difference or volume difference between the left ear and the right ear. Although the spatial impression is less pronounced here, panning has the advantage that each single sound source is perceived clearer. This increases speech intelligibility, for example.

EP2258120 B1 shows the parallel use of equalization and binaural filtering of surround audio signals for correcting the timbre. A channel of a surround audio signal is, on the one hand, filtered by a binaural filter for each side (left/right), and on the other hand delayed and equalized by an equalizer for each side. The two signals belonging to a respective same side are weighted and mixed, wherein for one side an additional delay of the equalized signal is inserted in order to generate interaural time differences (ITD). Further, head-related transfer functions (HRTFs) may be modified in order to compensate for timbral colorations. The head-related transfer functions for the left and right sides are aligned with each other such that the timbral coloration is reduced, which however reduces also the spatial effect.

Binaurally reproduced signals are often perceived as unnatural or unpleasant. Speech is sometimes difficult to understand and music sounds strange and therefore uncomfortable, for example since certain emphases intended by the musician are lost.

A further improvement of the spatial reproduction of audio signals would be desirable.

SUMMARY OF THE INVENTION

At least this problem is solved by the present invention. Claim 1 discloses a method for processing an audio signal for binaural virtualization, and in particular for partial binaural virtualization, according to an embodiment of the invention. Claim 14 discloses a corresponding device, according to another embodiment of the invention.

According to the invention, an improvement of the spatial reproduction of audio signals may be achieved by filtering an audio signal such that it is only partially binaurally virtualized. A degree of binaural virtualization can be freely chosen for the audio signal. In one embodiment, a control method is provided that enables a smooth transition between a complete binaural virtualization and a non-binaural virtualization that corresponds to panning. This may be done during mixing, i.e. during the authoring process, or later during post-processing or during playback. Partially, the binaural virtualization may also be effected by the temporal behavior of the filters for both sides, i.e. their phase responses.

According to the invention, the signal processing includes modifying the amplitude responses, corresponding to filtering curves, and/or the phase responses of the HRTFs which correspond to delays of the filters. The amplitude responses and phase responses can in principle be modified independently from each other. Both approaches can be used separately or together.

In particular, the signal processing for a transition from a binaural to a non-binaural virtualization that is perceived as smooth has at least two sections, in one embodiment. In a first section beginning with a complete binaural virtualization and the HRTFs that are usually used for that purpose, these HRTFs are modified with a decreasing binaural virtualization, without modifying their phase behavior or phase responses. In particular, the "dynamic range" of each HRTF is successively reduced until it is zero, i.e. until the HRTF value is frequency independent. This frequency independent value is the gain factor that corresponds to a stereo panning.

The "dynamic range" of an HRTF is understood herein as the difference between the highest and the lowest value of the HRTF within a frequency range. In a second section, which in one embodiment is adjacent to the first section, the phase behavior of the HRTF, or the delay respectively, is modified. The delay may be reduced, starting from a value that results from the "dynamic reduced" HRTFs, down to zero (or another constant value that is equal on both sides, left and right). At this point, the signal processing corresponds to the known stereo panning.

Further advantageous embodiments are disclosed in the following description and in the dependent claims.

An advantage of the invention is that audio objects or audio channels can be virtualized to a greater or lesser extent, due to a more binaural or more panning-like rendering or processing. In other words, a degree of binaural processing of an audio object may be freely chosen within a continuous range where the extremes are e. g. a complete binaural processing and a classical amplitude panning. This may be done by using e.g. a control device. A further advantage is that different audio objects or audio channels may be virtualized individually to different degrees and may then be superposed to each other.

BRIEF DESCRIPTION OF THE DRAWINGS

Further details and advantageous embodiments are shown in the drawings, wherein.

DETAILED DESCRIPTION

Figure 1:
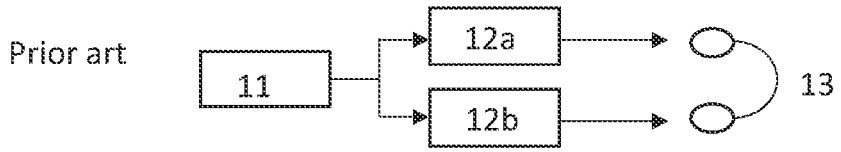
FIG. 1 shows the known principle of object-based binaural signal processing for a single audio source.
Figure 2:
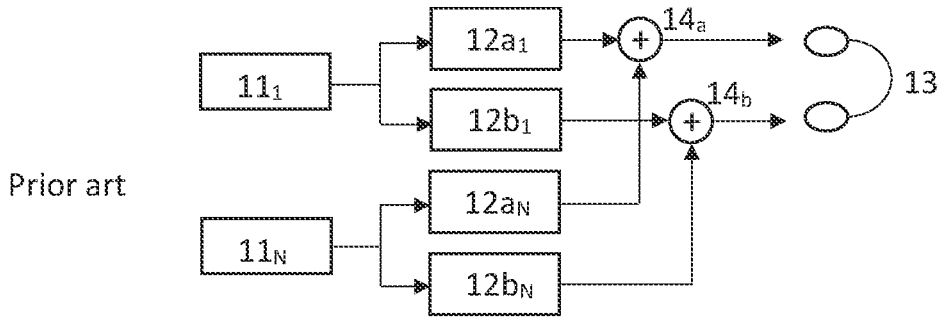
FIG. 2 shows the known principle of object-based binaural signal processing for the superposition of multiple audio sources.
Figure 3:
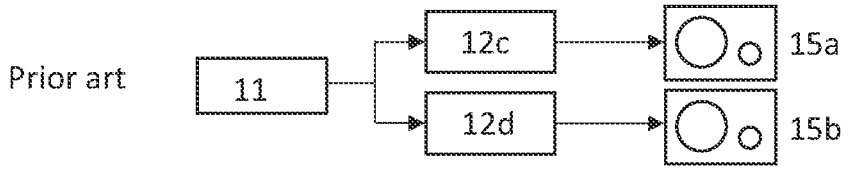
FIG. 3 shows the known principle of object-based transaural signal processing.
Figure 4:
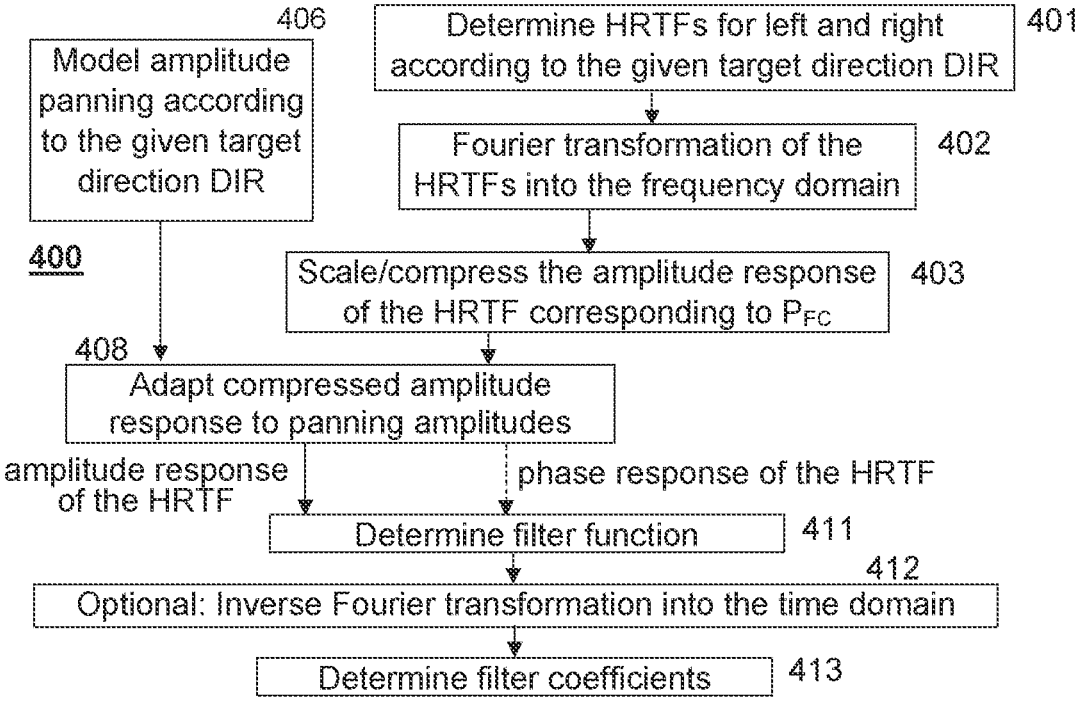
FIG. 4 shows a flow-chart of a method according to an embodiment.

FIG. 4 shows, in an embodiment, a flow-chart of a method 400 for processing a single channel input audio signal. A direction DIR and a processing parameter $P_{FC}$ for a degree of binaural virtualization are associated to the input audio signal, e.g. during authoring. The input audio signal may be e.g. a single audio object in an object-oriented audio format. However, it could also be e.g. a channel (left/right) of a stereo signal. From the input audio signal, output audio signals for playback at a left ear and a right ear of a listener, respectively, are to be generated, e.g. for headphones or for loudspeakers located near the ears. In a first step 401, head-related transfer functions (HRTFs) for the given target direction DIR are determined. These are a first head-related transfer function $HRTF_L$ for a left side output signal for the left ear of a listener and a second head-related transfer function $HRTF_R$ for a right side output signal for the right ear of the listener. The HRTFs may e.g. be coefficient data sets retrieved from a database that has stored coefficients of a plurality of HRTFs for different directions. If the coefficients of the determined HRTFs are provided by the database in the time domain format, they are in a second step 402 transformed into the frequency domain by using a Fourier transform (FT). Otherwise, if the data base provides already frequency domain coefficients, the step 402 may be skipped.

As described above, a second, substantially simpler way of processing is amplitude panning. A conventional amplitude panning for the given target direction DIR is modelled 406, which includes applying a first gain factor Gain_L for a left channel and a second gain factor Gain_R for a right channel to the single channel input audio signal. For example, for a certain given target direction DIR the first gain factor Gain_L may be −10 dB and the second gain factor Gain_R may be −6 dB, leading to a simple spatial virtualization of the audio object at a position rather to the right. For a target direction DIR that is just in front of the listener or behind the listener, both gain factors are usually essentially equal.

In the next step, the amplitude responses of the transformed head-related transfer functions are adjusted 403, 408 to the respective gain factors according to the processing parameter $P_{FC}$ for a degree of binaural virtualization. That is, the amplitude response of the first head-related transfer function $HRTF_L$ is brought closer to the first gain factor Gain_L to an extent depending on the processing parameter $P_{FC}$, and the amplitude response of the second head-related transfer function $HRTF_R$ is brought closer to the second gain factor Gain_R to an extent depending on the processing parameter $P_{FC}$. As explained below in more detail, this can be understood as scaling or compressing the amplitude responses of the HRTFs, approaching them to respective frequency independent target values and resulting in a first modified head-related transfer function $HRTF_{L,mod1}$ and a second modified head-related transfer function $HRTF_{R,mod1}$. This adjustment or approaching 403, 408 is stronger if the intended degree of binaural virtualization is lower, and vice versa. In an embodiment, the modified head-related transfer functions for a minimum degree of binaural virtualization are identical with the gain factors Gain_L, Gain_R, while for a maximum degree of binaural virtualization they are identical with the original head-related transfer functions. In an embodiment, the amplitude responses of the original head-related transfer functions are first, in a step 403, scaled or reduced according to the processing parameter $P_{FC}$ and then, in a further step 408, the scaled or reduced head-related transfer functions are adjusted or approached to the gain factors Gain_L, Gain_R by shifting (ie., by amplifying or attenuating the signals). In other embodiments, these steps 403, 408 may be swapped or may be executed simultaneously, or otherwise embedded in any processing.

Finally, filtering functions for the first and second modified head-related transfer functions $HRTF_{L,mod1}$, $HRTF_{R,mod1}$ are calculated 411 and transformed back to the complex spectrum. Ten, the filtering coefficients for implementing the filters are calculated 413. A first filter is implemented according to the first modified head-related transfer function $HRTF_{L,mod1}$ and a second filter is implemented according to the second modified head-related transfer function $HRTF_{R,mod1}$. Optionally, the modified head-related transfer functions $HRTF_{L,mod1}$, $HRTF_{R,mod1}$ may be transformed 412 into the time domain by an inverse Fourier transform before.

In an embodiment, the phase response of the first or second filter, respectively, results directly from the respective first or second modified head-related transfer function $HRTF_{L,mod1}$, $HRTF_{R,mod1}$. In another embodiment, however, the phase response of the first or second filter, respectively, may be modified. This modification may be based on the above-mentioned processing parameter $P_{FC}$ but it may also be based on a different second processing parameter $P_{TC}$. Further details are explained below.

Figure 5:
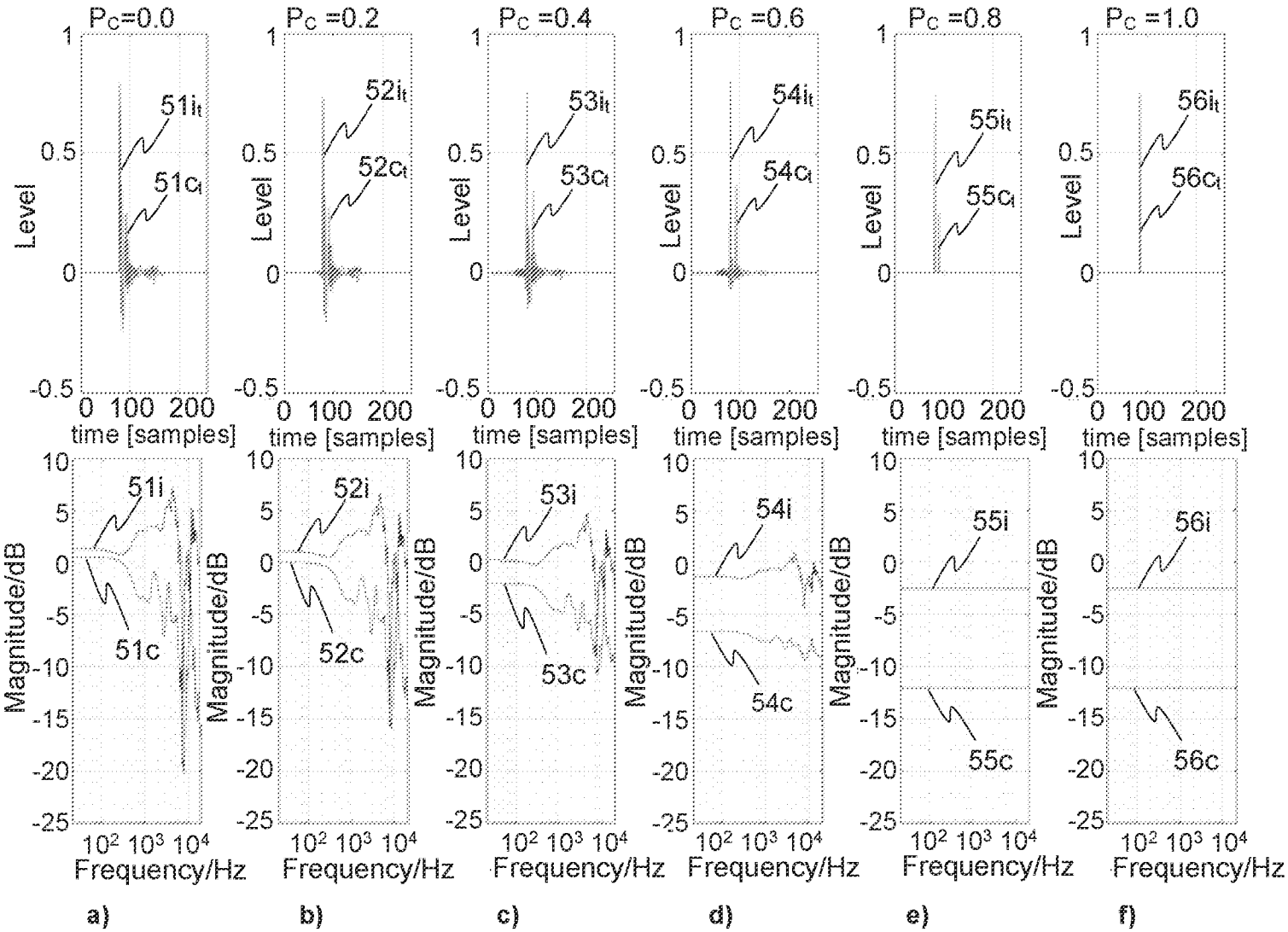
FIG. 5 shows impulse responses and frequency responses of the filters for different parameter values.

FIG. 5 shows, in one embodiment, impulse responses and frequency responses of exemplary filters for different parameter values. In this example, a processing parameter $P_C$ for a degree of binaural virtualization is composed from the above-mentioned first processing parameter $P_{FC}$ and a second processing parameter $P_{TC}$. The first processing parameter $P_{FC}$ modifies the filters' amplitude response or frequency response and may be referred to as "frequency clarity". The second processing parameter $P_{TC}$ modifies the filters' phase response and may be referred to as "time clarity". Table 1 shows exemplarily a relationship between the total processing parameter $P_C$, the first processing parameter $P_{FC}$ and the second processing parameter $P_{TC}$.

TABLE 1

| | Adjacent parameter sections | |
|---|---|---|
| Range of values for $P_C$ (Thr < 100%) | $B_1$ ($0 \leq P_C \leq$ Thr) | $B_2$ (Thr $\leq P_C \leq$ 100%) |
| $P_{FC}$ | 0% . . . 100% | 100% |
| $P_{TC}$ | 0% | 0% . . . 100% |

Figure 11:
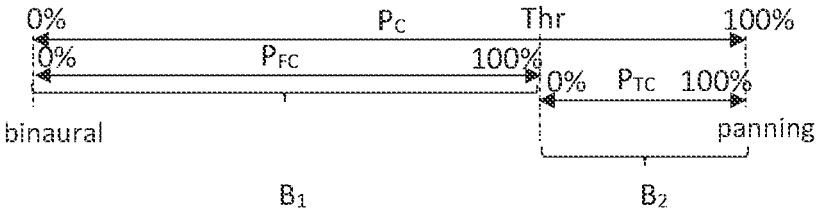
FIG. 11 shows a representation of different parameter ranges in an embodiment where two processing parameters are used.

This relationship is depicted in FIG. 11, where the value range of the processing parameter $P_C$ comprises two ranges or sections. A first range or section $B_1$ starts from $P_C$=0 (or 0%) and ranges up to a threshold Thr. A second range or section $B_2$ ranges from the threshold Thr up to $P_C$=1 (or 100%). The threshold may be, e.g., Thr=0.7 or Thr=0.6, . . . , 0.8, or similar. In the first section $B_1$, which is wider than the second section $B_2$ in this example, only the first processing parameter $P_{FC}$ is modified. In the second section $B_2$, only the second processing parameter $P_{TC}$ is modified. In the first section $B_1$, the binaural virtualization and thus the spatialization effect is stronger, while in the second section $B_2$ it is weaker. Overall, a change in the spatial effect that is perceived as uniform or smooth results over the control range of the processing parameter $P_C$. In this particular example, the change in the spatial effect is a decreasing spatial impression with an increase of the processing parameter $P_C$. However, it is clear that other implementations are possible where the spatial effect increases with an increase of the parameter.

This relationship is depicted in FIG. 5, where impulse responses and frequency responses (i.e. amplitude responses) of the filters for the first and second modified head-related transfer functions $HRTF_{L,mod1}$, $HRTF_{R,mod1}$ are exemplarily shown for different values of the processing parameter $P_C$. FIG. 5*a*) shows the situation for $P_C$=0.0, i.e. a maximum degree of binaural virtualization. This corresponds to $P_{TC}$=$P_{FC}$=0.0, and the amplitude responses shown in the lower part fully correspond to the amplitude responses of the original head-related transfer functions $HRTF_L$, $HRTF_R$, both for the side facing the sound source ("ipsilateral") 51*i* and for the side facing away from the sound source ("contralateral") 51*c*. In the time domain, these frequency responses correspond to the impulse responses for the ipsilateral side $\mathbf{51}i_t$ and for the contralateral side $\mathbf{51}c_t$ that are shown in the upper part of FIG. 5*a*). The level difference (interaural level difference, ILD) and the runtime difference (interaural time difference, ITD) between the first two peak values $\mathbf{51}i_t$, $\mathbf{51}c_t$ are clearly visible. This corresponds to a sound signal being weaker and arriving later at the contralateral ear than at the ipsilateral ear. Also an initial delay of about 80 ms prior to the first peak value $\mathbf{51}i_t$ is clearly visible, while the runtime difference is about 10-15 ms.

FIG. 5*b*) shows the responses for $P_C$=0.2. The processing parameter $P_C$ is in the first section $B_1$. The resulting effect is easier visible in the lower diagram showing the frequency response, namely in that the magnitude of the frequency response is scaled or reduced, respectively. That is, the difference between minimum and maximum values is smaller than in FIG. 5*a*) both for the ipsilateral 52*i* and the contralateral side 52*c*. At the same time, the curves of the diagram are shifted towards lower values (as compared to the original curves 51*i*, 51*c*), which is visible particularly for the lower frequencies. However, this shift applies to the complete respective curve 52*i*,52*c* (at least the audible spectrum portion). This effect is not so clearly visible in the time domain, as the upper part of FIG. 5*b*) shows.

Also in FIG. 5 *c*) for $P_C$=0.4, the processing parameter $P_C$ is in the first section $B_1$. The effect described above for FIG. 5*b*) is more pronounced, i.e. the head-related transfer functions 53*i*,53*c* for the ipsilateral side and the contralateral side are more reduced and more shifted. Together with the frequency response, also the phase response changes. Due to the modified frequency and phase responses, effects are now visible also in the time domain, namely an increase of signal portions occurring before the first peak value $\mathbf{53}i_t$. In FIG. 5*d*) for $P_C$=0.6, these changes continue to become more evident in that the frequency responses 54*i*,54*c* already show a magnitude that is clearly reduced or scaled, respectively. In the time domain however, the delay between the respective first two peak values is substantially unchanged for different values of $P_C$=0.0, . . . , 0.6 corresponding to FIG. 5*a*)-*d*).

FIG. 5*e*) shows the situation for $P_C$=0.8. The processing parameter $P_C$ is here at the edge of the first section $B_1$ or already in the second section $B_2$. As shown in the frequency response in the lower diagram, the curves are flat, i.e. the head-related transfer functions 55*i*,55*c* for the ipsilateral side and the contralateral side at least in the frequency range up to 10 kHz have assumed frequency independent values that correspond to gain values of a stereo amplitude panning. The curves from FIG. 5*a*)-*d*) have gradually approached these values. Between $P_C$=0.6 and $P_C$=0.8, the second section $B_2$ begins. Although the phase responses are not depicted directly, it is visible in the time domain diagram shown in the upper part of FIG. 5*e*) for $P_C$=0.8 and FIG. 5*f*) for $P_C$=1.0 that the impulse responses of the two sides approach each other (i.e. the time between the first and second peak values $\mathbf{55}i_t$,$\mathbf{55}c_t$ is reduced) until finally both peaks are equal for $P_C$=1.0. This is the main effect in the second section $B_2$, while the frequency responses 55*i*,56*i* and 55*c*,56*c* remain substantially unchanged, namely in that they represent constant gain factors. At this point, which is shown in FIG. 5*f*), the processing parameter $P_C$ has the value 1.0 (100%) and the audio signal processing fully corresponds to stereo amplitude panning, while in FIG. 5*a*) for a processing parameter value of $P_C$=0.0 (0%) the audio signal processing fully corresponds to binaural processing.

As mentioned above, the processing parameter $P_C$ for a degree of binaural virtualization in this example is composed of two separate sections $B_1$,$B_2$, which may be expressed by two separate processing parameters $P_{FC}$, $P_{TC}$. This embodiment is particularly advantageous since it results in a change of the spatial effect that is perceived as even. Alternatively, also other variants are possible, e.g. the following for $Thr_2$<$Thr_1$:

TABLE 2

| Overlapping parameter sections | | |
|---|---|---|
| Value range $P_C$ (for $Thr_1$, $Thr_2$ < 100, $Thr_2$ < $Thr_1$) | $0 \le P_C \le Thr_1$% | $Thr_2 \le P_C \le 100$% |
| $P_{FC}$ | 0% . . . 100% | 100% |
| $P_{TC}$ | 0% | 0% . . . 100% |

Here, the sections of the first processing parameter $P_{FC}$ and second processing parameter $P_{TC}$ overlap and there is a middle range between $Thr_2$ and $Thr_1$ in which both parameters are modified. In some cases. e.g. based upon individual preference, also this variant may be perceived as advantageous. In any case, the respective processing parameter $P_C$, $P_{TC}$, $P_{FC}$ may in principle be adjusted continuously from 0% to 100%.

Figure 6:
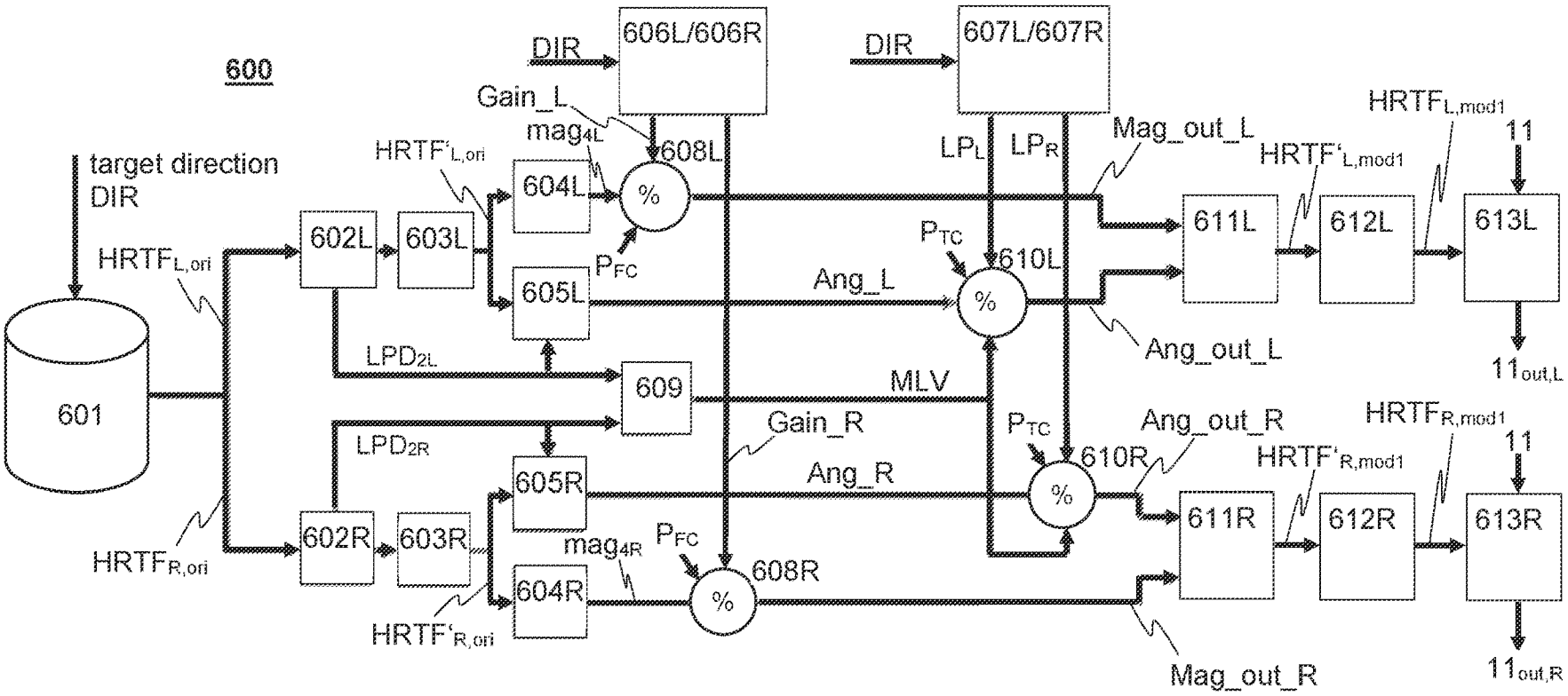
FIG. 6 shows a block diagram of a device according to an embodiment.

FIG. 6 shows a block diagram of a device 600 for processing a single-channel input audio signal 11, according to an embodiment. At least one processing parameter $P_C$, $P_{TC}$, $P_{CF}$ for a degree of binaural virtualization and a direction DIR is associated to the input audio signal 11. The device 600 comprises a storage or database 601 for storing and providing head-related transfer functions, including those head-related transfer functions that correspond to the direction DIR that is associated to the input audio signal 11. These are a first head-related transfer function $HRTF_{L,ori}$ for a left side output signal for a left ear of a listener and a second head-related transfer function $HRTF_{R,ori}$ for a right side output signal for a right ear of the listener.

Further, the device 600 comprises at least one gain factor determining module 606L,606R for determining a first gain factor Gain_L for the left side and a second gain factor Gain_R for the right side, which gain factors correspond to an amplitude panning for the direction DIR that is associated to the input audio signal 11. A rule or an algorithm for the amplitude panning may be predefined or selectable, such as e.g. Gain_L=0.5*(1+sin(□$_{azimuth,L}$)) and Gain_R=0.5*(1−sin(□$_{azimuth,R}$)), wherein □$_{azimuth}$ ∈[−180°, . . . , 180° ] is the respective angle to the front direction. In other embodiments, other audio virtualization rules and in particular other panning rules may be used, which may be based for example on A-B miking (time-of-arrival stereophony) with a given distance between the microphones (base distance). For a pure amplitude panning, the gains are to be set to Gain_L=Gain_R=0.

Further, the device 600 comprises a transformation module 603L,603R each for Fourier transforming 730 the first and second head-related transfer functions $HRTF_{L,ori}$, $HRTF_{R,ori}$ into the frequency range, resulting in respective transformed transfer functions $HRTF'_{L,ori}$, $HRTF'_{R,ori}$. Then the amplitude responses and the phase responses of the transformed transfer functions $HRTF'_{L,ori}$, $HRTF'_{R,ori}$ may be processed in principle independent from each other.

In an embodiment, the device 600 comprises two scaling and shifting modules 604L, 604R, 608L, 608R, one for each side, left and right. A first scaling and shifting module 604L, 608L for the left-hand side adjusts the amplitude response of the first head-related transfer function $HRTF'_{L,ori}$ to be closer to the first gain factor Gain_L according to a processing parameter $P_{FC}$ by scaling and shifting, for instance according to Mag_out_L=(1−$P_{FC}$)*$mag_{4L}$+$P_{FC}$*Gain_L. This results in an amplitude response Mag_out_L of a first modified head-related transfer function $HRTF_{L,mod1}$. Likewise, a second scaling and shifting module 604R, 608R for the right-hand side adjusts the amplitude response of the second head-related transfer function $HRTF'_{R,ori}$ to be closer to the second gain factor Gain_R according to the processing parameter $P_{FC}$ by scaling and shifting, for instance according to Mag_out_R=(1−$P_{FC}$)*$mag_{4R}$+$P_{FC}$*Gain_R. This results in an amplitude response Mag_out_R of a second modified head-related transfer function $HRTF_{R,mod1}$. As described above, the binaural virtualization effect is the stronger, the closer the amplitude responses Mag_out_L, Mag_out_R of the modified head-related transfer functions $HRTF_{L,mod1}$, $HRTF_{R,mod1}$ are to the original head-related transfer functions $HRTF_{L,ori}$, $HRTF_{R,ori}$. In other words, the approaching of the amplitude responses to the gain factors Gain_L, Gain_R is stronger pronounced for a lower degree of binaural virtualization than for a higher degree of binaural virtualization. This applies at least in a limited frequency range, e.g. below a certain maximum frequency (Nyquist frequency); it needs not necessarily be valid over the full frequency range. Therefore it may be sufficient to apply the processing in the limited frequency range.

The device further comprises for each side a configurable filter 613L, 613R for filtering the input audio signal 11 to obtain the left output signal and right output signal, and a filter configuration module 611L, 611R for each of the configurable filters. The first filter configuration module 611L calculates first filter coefficients from the amplitude response Mag_out_L of the first modified head-related transfer function $HRTF_{L,mod1}$, and the first configurable filter 613L is configured with the first filter coefficients. The second filter configuration module 611R calculates second filter coefficients from the amplitude response Mag_out_R of the second modified head-related transfer function $HRTF_{R,mod1}$, and the second configurable filter 613R is configured with the second filter coefficients. By filtering the input audio signal 11 with the first and the second configured filters 613L, 613R, audio signals $\mathbf{11}_{out,L}$,$\mathbf{11}_{out,R}$ are created that are partially binaurally virtualized to a certain degree, according to the associated parameter. They may be reproduced, e.g. via headphones. Each of the above-mentioned modules and filters individually or together may be implemented e.g. by one or more software-configurable processors or computers.

Figure 7:
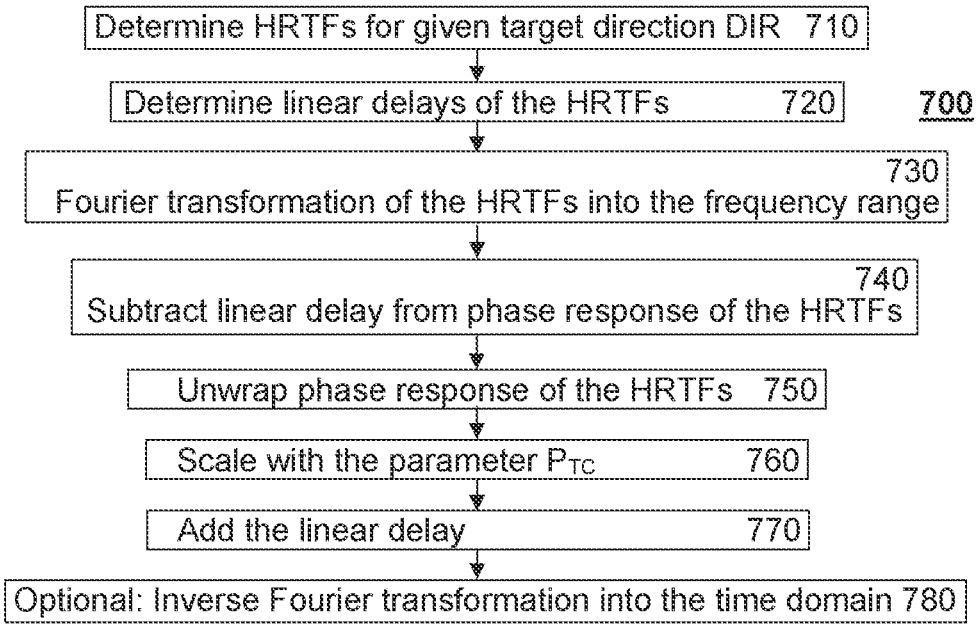
FIG. 7 shows a flow-chart for determining the phase response of a filter.

In the embodiment as described above, mainly the amplitude responses of the head-related transfer functions may be modified. In another embodiment, the phase responses or delays respectively of the head-related transfer functions may be modified. Both embodiments are independent from each other and may be combined. Therefore both are shown together in FIG. 6. The following refers also to FIG. 7 showing a flow-chart of a method 700 for determining the phase response of a configurable filter 613L, 613R. The first steps for determining 710 the head-1*o* related transfer function for the given target direction DIR and performing a Fourier transformation 730 have already been mentioned above.

For modifying the phase responses or delays respectively of the head-related transfer functions $HRTF_{L,ori}$, $HRTFa_{R,ori}$, the device 600 may optionally comprise a delay determining module 602L, 602R each for calculating 720 the respective linear delay or group delay $LPD_{2L}$, $LPD_{2R}$ of the head-related transfer functions $HRTF_{L,ori}$, $HRTF_{R,ori}$ for the left and right sides as received from the database. Alternatively, these values may also be received from the database, so that they need not be re-calculated again with each call. The Fourier transformation 730 may be performed before or after or concurrently with the step 720 of determining the linear delays. The device 600 further comprises an MLV calculation module 609 for calculating a mean or average linear delay MLV from the linear delays $LPD_{2L}$, $LPD_{2R}$ of the two sides, for example according to $MLV=0.5*(LPD_{2L}+LPD_{2R})$.

Further, the device 600 comprises a subtraction module 605L, 605R each for subtracting 740 the respective group delay $LPD_{2L}$, $LPD_{2R}$ from the phase response of the transformed head-related transfer function $HRTF'_{L,ori}$, $HRTF'_{R,ori}$, whereby a normalized first phase response and a normalized second phase response are generated. Since these normalized phase responses may contain phase jumps of 360°, they are unwrapped 750. That is, such phase jumps are eliminated from the phase responses by adding or subtracting 360° or multiples thereof. Unwrapping may also include changing absolute jumps greater than 180° to their 360° complement. The resulting so-called unwrapped phase responses Ang_L, Ang_R are free from phase jumps. The unwrapped phase responses Ang_L, Ang_R are then scaled 760 by interpolation through phase interpolation modules 610L, 610R. The interpolation may be a linear interpolation between the respective unwrapped phase response Ang_L, Ang_R and the average linear delay MLV according to the processing parameter $P_C$, $P_{TC}$ for a certain degree of binaural virtualization, e.g. for the left-hand side according to $$\text{LinearDelayL}=(1-p_{TC})*LPD_{2L}+p_{TC}*MLV$$

$$\text{Ang_out_}L=(1-p_{TC})*\text{Unwrap}(\text{ang5}L-LPD_{2L})+p_{TC}*(LP_L+\text{LinearDelayL})$$

where ang5L is the phase response of the head-related transfer function $HRTF'_{L,ori}$ after Fourier transformation and before unwrapping, and LPL is an optional additional delay. This results in the modified phase responses Ang_out_L, Ang_out_R that are then fed to the filters 613L, 613R. The phase responses may optionally be modified by adding 770 a (possibly constant) delay $LP_L$, $LP_R$, which may be received from a panning module 607L, 607R that models a runtime panning. The respective additional delay for the left and right side may depend on the direction DIR.

From the modified phase responses Ang_out_L, Ang_out_R and/or the interpolated amplitude responses Mag_out_L, Mag_out_R, the modified head-related transfer functions $HRTF_{L,mod1}$, $HRTF_{R,mod1}$ or their coefficients respectively for configuring the filters 613L, 613R may be generated in the filter configuration modules 611L, 611R. Before configuring the filters, the modified filtering functions including the modified phase responses Ang_out_L, Ang_out_R may optionally be re-transformed 780 into the time domain by inverse Fourier transformation 612L, 612R if required.

Figure 8:
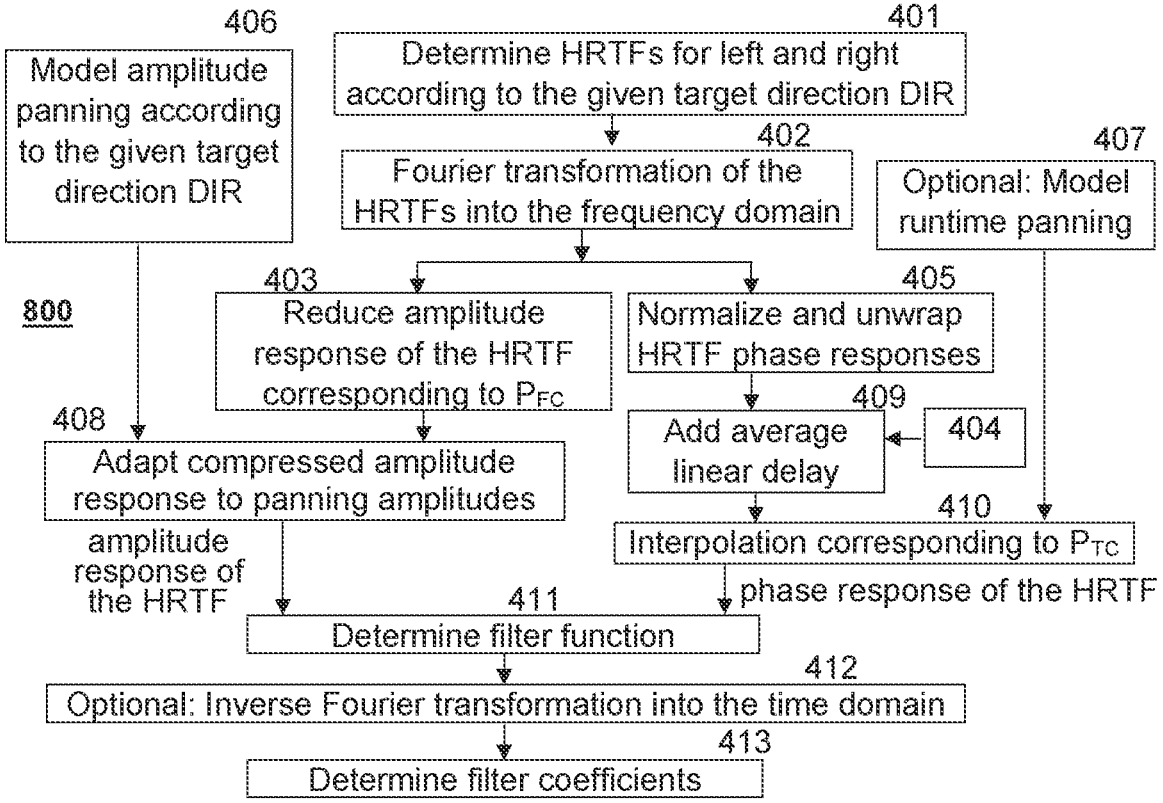
FIG. 8 shows a flow-chart according to an embodiment with an interpolation of the phase response.

FIG. 8 shows a flow-chart of a method 800 including an interpolation of the phase response, according to an embodiment. Compared with the flow-chart in FIG. 4, additional steps are comprised for normalizing and unwrapping 405 the phase responses of the head-related transfer functions, as described above, determining 404 the average linear delay (or group delay respectively) MLV and adding it 409 to the phase responses. Then follows an interpolation 410 according to the processing parameter $P_{TC}$, as described above, either towards the average linear delay MLV or, optionally, towards a different runtime panning that may be modelled separately 407. The respective modelled runtime values may be retrievable from a memory.

From the interpolation results the desired phase response Ang_out_L, Ang_out_R, which is combined with the desired amplitude response Mag_out_L, Mag_out_R so as to obtain the target head-related transfer functions $HRTF_{L,mod1}$, $HRTF_{R,mod1}$. Thus, the filtering function is formed or determined respectively 411, from which then the filtering coefficients are determined 413 directly or after an optional inverse Fourier transformation 412, 612.

Figure 9:
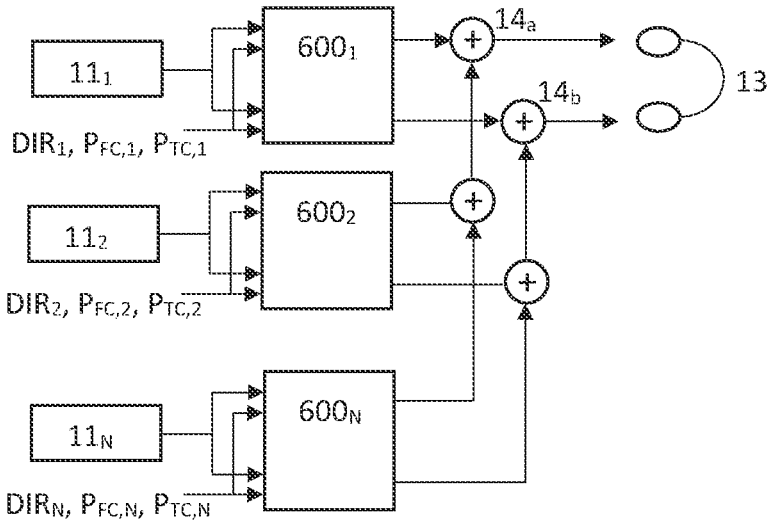
FIG. 9 shows, in an embodiment, a block diagram of a device for superimposing multiple audio sources for playback via headphones, wherein the audio sources are binaurally virtualized to different degrees.

FIG. 9 shows, in an embodiment, a block diagram of a device for superimposing multiple audio sources that may be differently binaurally virtualized for playback via headphones. Multiple input audio signals $\mathbf{11}_1,\mathbf{11}_2, \ldots, \mathbf{11}_N$ from the audio sources may be received in one or more reception signals. To each input audio signal $\mathbf{11}_1,\mathbf{11}_2, \ldots, \mathbf{11}_N$ may be assigned not only an individual direction $DIR_1$, $DIR_2$, . . . , $DIR_N$, but also an individual degree of virtualization by means of one or more individual processing parameters $P_{FC,1}$, $P_{FC,2}$, . . . , $P_{FC,N}$, $P_{TC,1}$, $P_{TC,2}$, . . . , $P_{TC,N}$, as described above. The direction and, in principle, the processing parameters may vary over time (e.g. depending on a video scene). The respective filtered audio signals for each side are superimposed to each other $\mathbf{14}_a,\mathbf{14}_b$ and fed to the two sides of a headphone 13. Thus, it is possible to virtualize certain audio objects different from other audio objects, for example for the soundtrack of a movie. For example, speech intelligibility may be improved by assigning a lower degree of binaural virtualization to speech than to music or ambient sound. Correspondingly, it is also possible to classify input audio signals e.g. by assigning them classification parameters $P_{Typ}$ such that the same processing parameters $P_C$, $P_{TC}$, $P_{FC}$ apply to all audio objects of a given class and different classes of audio signals have different processing parameters. This enables an automatic gradual binaural virtualization of audio signals (e.g., all speech signals are weakly binaurally virtualized while all ambient sounds and/or music are strongly binaurally virtualized). A classification may also be performed automatically, based on the audio signal. E.g. artificial intelligence may be used for differentiating between music, speech, ambient noises, effects and/or other audio classes. The corresponding parameters may then be assigned automatically to the audio signals, depending on the classification.

The device for superimposing multiple audio sources may comprise a plurality of separate devices 600 for processing single channel input audio signals each, as described above. The devices may also be integrated into a single device, however, which may lead to synergy effects (e.g. a shared database). Further, there may be cases where it is useful to perform the above-described processing for only one of the sides, left or right, while the audio signal for the other side may be processed differently.

Figure 10:
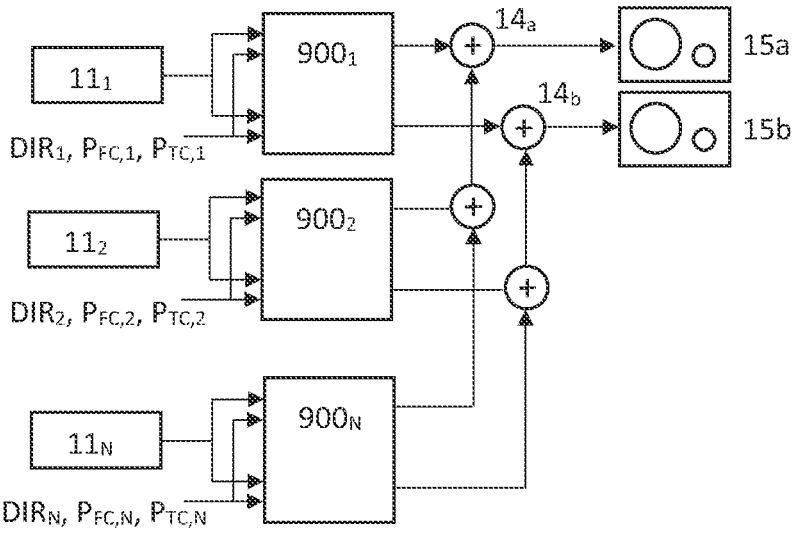
FIG. 10 shows, in an embodiment, a block diagram of a device for superimposing multiple audio sources for playback via loudspeakers, wherein the audio sources are binaurally virtualized to different degrees.

It should be noted that the invention is not only applicable for gradual binaural virtualization, but also for gradual transaural virtualization. A device 600 for binaural virtualization differs from a device for transaural virtualization mainly in the type of transfer functions that are provided by the database. FIG. 10 shows, in an embodiment, a block diagram of a device 900 for superimposing multiple audio sources, which are binaurally (or rather transaurally) virtualized to different degrees, for audio playback via loudspeakers 15*a*, 15*b*. In principle, it corresponds in structure and function to the example shown in FIG. 9, except that the transfer functions or filtering functions and the output transducers are different.

The processing parameters $P_C$, $P_{TC}$, $P_{FC}$ or classification parameters $P_{Typ}$ respectively may be stored as metadata for later use in the input audio signals, e.g. for real-time rendering in a playback device during reproduction. Thus, for example, a system may be realized in which a head tracker provides additional information about the position and orientation of the listener. Apart from the real-time processing, the used parameters may also be defined and stored in advance, e.g. by a sound engineer. Tus, the invention may provide to sound engineers new tools for continuously controlling a gradual degree of tonal changes with respect to spectrum and/or phase. Moreover, the parameter values and their changes over time may be stored. Instead of assigning only a single value to the whole audio signal, the signal may be subdivided into blocks (e.g. of 1 ms length or for the length of a scene) and individual parameter values may be assigned to each of these blocks. Audible artifacts may be minimized by suitable windowing and cross-fading.

The invention is particularly advantageous for audio processing devices, for example. It may be implemented based on a configurable computer or processor, in an exemplary embodiment. The configuration may be achieved by a computer-readable storage medium having stored thereon instructions that when executed on a computer cause the computer to perform a method as described above.

Various combinations of the above-described features with each other or with further features are considered to be within the scope of the invention, even if such combination is not expressly mentioned herein.

The invention claimed is:

1. A method for processing an input audio signal, the method comprising:

assigning a direction and at least one processing parameter for a degree of binaural virtualization to the input audio signal;

determining a first head-related transfer function for a left output signal for a left-side ear of a listener and a second head-related transfer function for a right output signal for a right-side ear of the listener, wherein the first and second head-related transfer functions correspond to the direction assigned to the input audio signal;

determining a first gain factor for the left side and a second gain factor for the right side, wherein the first and second gain factors correspond to an amplitude panning for the direction assigned to the input audio signal;

modifying an amplitude response of the first head-related transfer function according to the processing parameter to bring the amplitude response closer to the first gain factor, wherein a first modified head-related transfer function is obtained;

modifying an amplitude response of the second head-related transfer function according to the processing parameter to bring the amplitude response closer to the second gain factor, wherein a second modified head-related transfer function is obtained;

wherein at least in a first frequency range the amplitude responses for a lower degree of binaural virtualization are brought closer to the respective gain factor than for a higher degree of binaural virtualization;

calculating a first filter according to the first modified head-related transfer function and a second filter according to the second modified head-related transfer function;

filtering the input audio signal with the first filter and the second filter, wherein a filtered audio signal each for the left ear and the right ear of the listener is obtained that is partially binaurally virtualized according to said assigned degree.

2. The method according to claim 1, wherein the input audio signal is one of a mono signal, a channel of a channel-based audio signal and an audio object of an object-based audio signal.

3. The method according to claim 1, wherein said modifying the amplitude response of the first head-related transfer function and said modifying the amplitude response of the second head-related transfer function comprises:

transforming the first and second head-related transfer functions into the frequency domain by means of a Fourier transformation, wherein a transformed first head-related transfer function and a transformed second head-related transfer function are obtained;

calculating a first amplitude response for the first head related transfer function and a second amplitude response for the second head related transfer function;

interpolating according to the processing parameter between the amplitude frequency response of the transformed first head-related transfer function and the determined first gain factor, wherein a transformed first modified head-related transfer function is obtained;

interpolating according to the processing parameter between the amplitude frequency response of the transformed second head-related transfer function and the determined second gain factor, wherein a transformed second modified head-related transfer function is obtained; and re-transforming the transformed first and second modified head-related transfer functions into the time domain, wherein the first and second modified head-related transfer functions are obtained.

4. The method according to claim 3, further comprising:

determining a first group delay of the first head-related transfer function and a second group delay of the second head-related transfer function;

subtracting the determined first group delay from the phase response of the transformed first head-related transfer function, whereby a normalized first phase response results;

unwrapping the normalized first phase response, wherein phase jumps in the normalized first phase response are eliminated by adding or subtracting a value of 360° or multiples thereof, and wherein an unwrapped first phase response is obtained;

subtracting the determined second group delay from the phase response of the transformed second head-related transfer function, whereby a normalized second phase response results;

unwrapping the normalized second phase response, wherein phase jumps in the normalized second phase response are eliminated by adding or subtracting a value of 360° or multiples thereof, and wherein an unwrapped second phase response is obtained;

calculating an average linear delay based on the determined first and second group delays;

performing a linear interpolation between the unwrapped first phase response and the average linear delay according to the at least one processing parameter, wherein a modified first phase response is obtained;

performing a linear interpolation between the unwrapped second phase response and the average linear delay according to the at least one processing parameter, wherein a modified second phase response is obtained;

assigning the modified first phase response to the first filter with the first modified head-related transfer function; and assigning the modified second phase response to the second filter with the second modified head-related transfer function.

5. The method according to claim 4, wherein the degree of binaural virtualization is selectable by a single processing parameter, and wherein in a first range of the processing parameter the interpolating is performed between the amplitude response of the transformed head-related transfer functions and the determined gain factors, and wherein in a second range of the processing parameter the interpolating is performed between the unwrapped phase responses and the average linear delay.

6. The method according to claim 5, wherein the first range and the second range do not overlap.

7. The method according to claim 1, wherein the degree of binaural virtualization is selectable by at least two parameters that are independent from each other.

8. The method according to claim 1, wherein the method is applied to at least two different single channel input audio signals, and wherein individual directions that may optionally differ from each other and individual processing parameters for an individual degree of binaural virtualization that may optionally differ from each other are assigned to each of the at least two input audio signals.

9. The method according to claim 8, wherein a first direction and at least one first processing parameter for a first degree of binaural virtualization are assigned to a first input audio signal, and wherein a first and a second filter for the first input audio signal are calculated, and wherein a second direction and at least one second processing parameter for a second degree of binaural virtualization are assigned to a second input audio signal, and wherein a first and a second filter for the second input audio signal are calculated, and wherein the first and second input audio signals after filtering by their respective first filters are superimposed to each other to obtain a first output signal for a left-hand side, and wherein the first and second input audio signals after filtering by their respective second filters are superimposed to each other to obtain a second output signal for a right-hand side.

10. The method according to claim 8, wherein the at least two single channel input audio signals are received in a common reception signal, the reception signal containing also information about the directions and the processing parameters for a degree of binaural virtualization.

11. The method according to claim 4, wherein an adjustable additional delay is added to at least one of the modified first phase response and the modified second phase response.

12. The method according to claim 1, wherein the determining the first gain factor for the left side and the second gain factor for the right side is performed according to a given or selectable panning rule.

13. A non-transitory computer readable storage medium having stored thereon instructions that when executed by a computer or processor cause the computer or processor to perform the method according to claim 1.

14. A device for processing an input audio signal to which at least one processing parameter for a degree of binaural virtualization and a direction are assigned, the device comprising:

a database adapted for providing a first head-related transfer function for a left output signal for a left-side ear of a listener, and for providing a second head-related transfer function for a right output signal for a right-side ear of the listener, wherein the head-related transfer functions correspond to the direction assigned to the input audio signal;

at least one gain factor determining module adapted for determining a first gain factor for the left side and a second gain factor for the right side, wherein the first and second gain factors correspond to an amplitude panning for the direction assigned to the input audio signal;

at least one first scaling and shifting module for the left side, the first scaling and shifting module being adapted to bring an amplitude response of the first head-related transfer function closer to the first gain factor according to the processing parameter by scaling and shifting, wherein an amplitude response of a first modified head-related transfer function is obtained;

at least one second scaling and shifting module for the right side, the second scaling and shifting module being adapted to bring an amplitude response of the second head-related transfer function closer to the second gain factor according to the processing parameter by scaling and shifting, wherein an amplitude response of a second modified head-related transfer function is obtained;

where at least in a first frequency range the amplitude responses for a lower degree of binaural virtualization are brought closer to the respective gain factor than for a higher degree of binaural virtualization;

a configurable first filter and a configurable second filter adapted to filter the input audio signal;

a first filter configuration module adapted to calculate first filter coefficients from the amplitude response of the first modified head-related transfer function, and further adapted to configure the first filter with the first filter coefficients;

a second filter configuration module adapted to calculate second filter coefficients from the amplitude response of the second modified head-related transfer function, and further adapted to configure the second filter with the second filter coefficients;

wherein said filtering the input audio signal with the first and second configurable filters results in an audio signal that is partially binaurally virtualized according to the assigned degree.

15. The device according to claim 14, further comprising a transformation module each for the left and the right side, the transformation modules being adapted for transforming the first and second head-related transfer functions into the frequency domain, wherein transformed head-related transfer functions are obtained;

wherein the scaling and shifting modules scale and shift the amplitude responses of the transformed head-related transfer functions, wherein transformed amplitude responses of the modified head-related transfer functions are obtained; and wherein the first and second filter configuration modules calculate the filter coefficients from the transformed amplitude responses.

16. The device according to claim 15, further comprising at least one re-transformation module for performing inverse Fourier transformation of said transformed amplitude responses of the modified head-related transfer functions, wherein the filter configuration modules calculate the filter coefficients from the re-transformed amplitude responses.

17. The device according to claim 14, wherein said at least one processing parameter for a degree of binaural virtualization and said direction are assigned to the input audio signal within the device, and wherein the device further comprises:

an assignment module adapted for performing said assigning the at least one processing parameter for a degree of binaural virtualization and the direction to the input audio signal.

* * * * *